US005503784A

United States Patent [19]

Balk

[11] Patent Number: 5,503,784

[45] Date of Patent: Apr. 2, 1996

[54] METHOD FOR PRODUCING NONWOVEN THERMOPLASTIC WEBS

[75] Inventor: Hermann Balk, Troisdorf, Germany

[73] Assignee: Reifenhauser GmbH & Co, Maschinenfabrik, Troisdorf, Germany

[21] Appl. No.: 300,390

[22] Filed: Sep. 2, 1994

[30] Foreign Application Priority Data

Sep. 23, 1993 [DE] Germany ..... 43 32 345.6

[51] Int. Cl.[6] ..... B29C 47/92; D01D 5/098

[52] U.S. Cl. ..... 264/40.3; 264/210.8; 264/211.14; 264/555

[58] Field of Search ..... 264/40.3, 210.8, 264/211.14, 211.15, 555

[56] References Cited

U.S. PATENT DOCUMENTS

| | | | |
|---|---|---|---|
| 5,034,182 | 7/1991 | Sze et al. | 264/555 |
| 5,141,700 | 8/1992 | Sze | 264/555 |
| 5,244,723 | 9/1993 | Anderson et al. | 264/555 X |

*Primary Examiner*—Leo B. Tentoni
*Attorney, Agent, or Firm*—Herbert Dubno

[57] ABSTRACT

A spun-bond apparatus can be operated with additional high-pressure jets at the outlet gap immediately above the collecting belt and below the intermediate passage connecting that gap with the cooling chamber to establish a higher velocity of the filaments which are collected in the nonwoven fabric on the belt.

6 Claims, 3 Drawing Sheets

METHOD FOR PRODUCING NONWOVEN THERMOPLASTIC WEBS

FIELD OF THE INVENTION

My present invention relates to a process for operating a spun-bond apparatus for the continuous production of nonwoven webs from thermoplastic synthetic resin filaments at high filament speeds, to an apparatus operated in accordance with that method and to a method of producing such nonwoven webs. More particularly the invention relates to the production of such nonwoven mats or fleece by the spun-bond technique with high filament speeds, generally of the order of 3000 m/min and more and usually 5000 m/min and more. The filament speed reflects the efficiency and output of the spun-bond apparatus and the stretching of the filament.

BACKGROUND OF THE INVENTION

A spun-bond apparatus generally comprises a spinneret from which a curtain of thermoplastified filaments emerge at a temperature equal to or above the melt temperature of the thermoplastic synthetic resin, a cooling unit below the spinneret for quenching the thermoplastified synthetic resin, a discharge gap through which the filaments are entrained, at least in part by the cooling air, and an intermediate passage between the cooling device and the discharge gap through which the filament curtain is guided, the filaments being stretched along the path from the spinneret to a collecting belt below the discharge gap at which the mat, fleece or jumble of filaments from the gap can be collected in a continuous web. Below the collecting belt, which is air-permeable, the region at which the web collects can be evacuated.

The cooling air passes via the intermediate passage into the discharge gap and impinges upon the collecting belt together with the filaments.

The discharge gap can, in vertical section, have the configuration of a venturi nozzle, with a convergence toward a constriction and possibly a divergence after the constriction. Preferably the gap is a parallel gap, i.e. a gap defined between two generally parallel walls.

In some known spun-bond apparatuses, the filament speeds attain values of 1000 m/min to 2500 m/min depending upon the configuration and arrangement of these structures.

OBJECTS OF THE INVENTION

It is the principal object of the present invention to provide an improved system for the spun-bond production of nonwoven webs of thermoplastic synthetic resin filament which will allow the increase in the filament velocity at a minimum cost.

More specifically, it is an object of the invention to improve a spun-bond apparatus so that the throughput of the synthetic resin filament is increased and the production rate enhanced without encountering drawbacks.

An object of the invention is to provide an improved method of operating a spun-bond apparatus to eliminate drawbacks thereof while increasing the filament velocity at relatively low cost and with a minimum of complexity.

Still another object of the invention is to provide an improved method of making nonwoven webs of synthetic resin filaments whereby drawbacks of earlier systems, especially limitations on filament velocity, are eliminated.

SUMMARY OF THE INVENTION

These objects and others which will become apparent hereinafter are attained in a method of operating a spun-bond apparatus for the continuous formation of a nonwoven web of thermoplastic synthetic resin filament with a predetermined high filament velocity, in which the spun-bond apparatus has a spinneret from which the thermoplastified filaments descend as a filament curtain, a cooling unit, a discharge gap forming a unit blowing the filaments downwardly and receiving the cooled filament curtain, an intermediate passage between the cooling device and the discharge gap, and a collecting device for receiving the fleece or nonwoven web and having a collecting conveyor belt for that purpose.

According to the invention, the cooled filament curtain is additionally entrained by jets of drive air in the discharge gap and the filament velocity is established by a transfer of flow energy from the jets to the filaments.

A plurality of jets from one or both sides and of more or less round cross section can be used although it is preferred to provide slit-shaped jets. It will be understood that, in the discharge gap, a further cooling of the filaments can occur.

It has been found, surprisingly, that with the aid of the jets of drive air, the flow energy of the jets can advantageously be coupled to the filaments so that an additional tension is applied to the filaments at the discharge gap. The volume of air required for this purpose is comparatively small, especially if the air is delivered at a high pressure, say 5 to 20 bar.

The filament velocity or speed can be controlled without difficulty utilizing this principle.

One of the surprising advantages is that the volume of air required to control the velocity of the filament is comparatively small. By contrast, when it is desired to increase the volume of the cooling air to increase the velocity of the cooling air through the intermediate passage and the discharge gap, significant volumes are required, the pressure of the cooling air must be increased inordinately and considerable cost is generated.

All parts involved in the supply and displacing of the cooling air and the seals, especially in the spinning region must be made larger. The increased volume rate of flow of cooling air must be treated in accordance with the thermodynamic process parameters and this requires greater expense for the processing apparatus. It is, therefore, especially important to the invention that at low cost and with relatively little increase in the volume rate of flow, utilizing a high-pressure pump, the volume of gas for the jets can be generated.

The invention comprises a method of operating a spun-bond apparatus for continuously producing a nonwoven web of thermoplastic synthetic resin filaments, wherein:

a downwardly moving curtain of the filaments formed by a spinneret passes in succession through a cooling chamber, an intermediate passage and a discharge gap to be collected in a nonwoven web upon a collecting conveyor belt below the discharge gap, the improvement which comprises the steps of:

directing jets of driving air against the curtain of filaments in the discharge gap and imparting to the filaments flow energy of the jets; and regulating a speed with which the filaments traverse the gap and collect upon the belt with the jets.

The jets can be directed against the curtain of films at a discharge end of the gap, i.e. an end of the gap proximal to the belt, or at an entry end of the gap, i.e. the side of the gap proximal to the intermediate duct.

The jets are preferably generated at a pressure of about 15 bar.

The spun-bond apparatus can comprise a spinneret for generating a descending curtain of thermoplastified synthetic resin filaments;

means forming a cooling chamber below the spinneret traversed by the curtain of filaments for cooling same, the cooling chamber having means for feeding a cooling air to the chamber at a pressure of less than 3 bar;

means forming a discharge gap spaced below the cooling chamber for discharging filaments of the curtain downwardly;

an intermediate passage between the cooling chamber and the discharge gap and enclosing the curtain of filaments whereby cooling air from the cooling chamber and the curtain of filaments are guided into the discharge gap;

a collecting conveyor belt below the discharge gap for collecting filaments from the gap in a continuous nonwoven web;

nozzle means at the gap forming jets of driving air trained against the curtain of filaments in the discharge gap and imparting to the filaments flow energy of the jets; and means for supplying the driving air at high pressure to the nozzle means.

The means for feeding the cooling air to the chamber can supply the cooling air at a pressure of 0.05 to one bar.

The invention also comprises a method of producing the nonwoven web through the steps of (a) generating a descending curtain of thermoplastified synthetic resin filaments in a spinneret;

(b) cooling the descending curtain of thermoplastified synthetic resin filaments in a cooling chamber below the spinneret and feeding a cooling air to the chamber at a pressure of less than 3 bar;

(c) passing the curtain of filaments through a discharge gap spaced below the cooling chamber for discharging filaments of the curtain downwardly;

(d) guiding the curtain of filaments along an intermediate passage between the cooling chamber and the discharge gap whereby cooling air from the cooling chamber and the curtain of filaments are guided into the discharge gap;

(e) collecting the curtain of filaments on a collecting conveyor belt below the discharge gap from the gap in a continuous nonwoven web;

(f) training jets of driving air against the curtain of filaments in the discharge gap and imparting to the filaments flow energy of the jets; and (g) supplying the driving air at a pressure of 5 to 20 bar to the jets.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
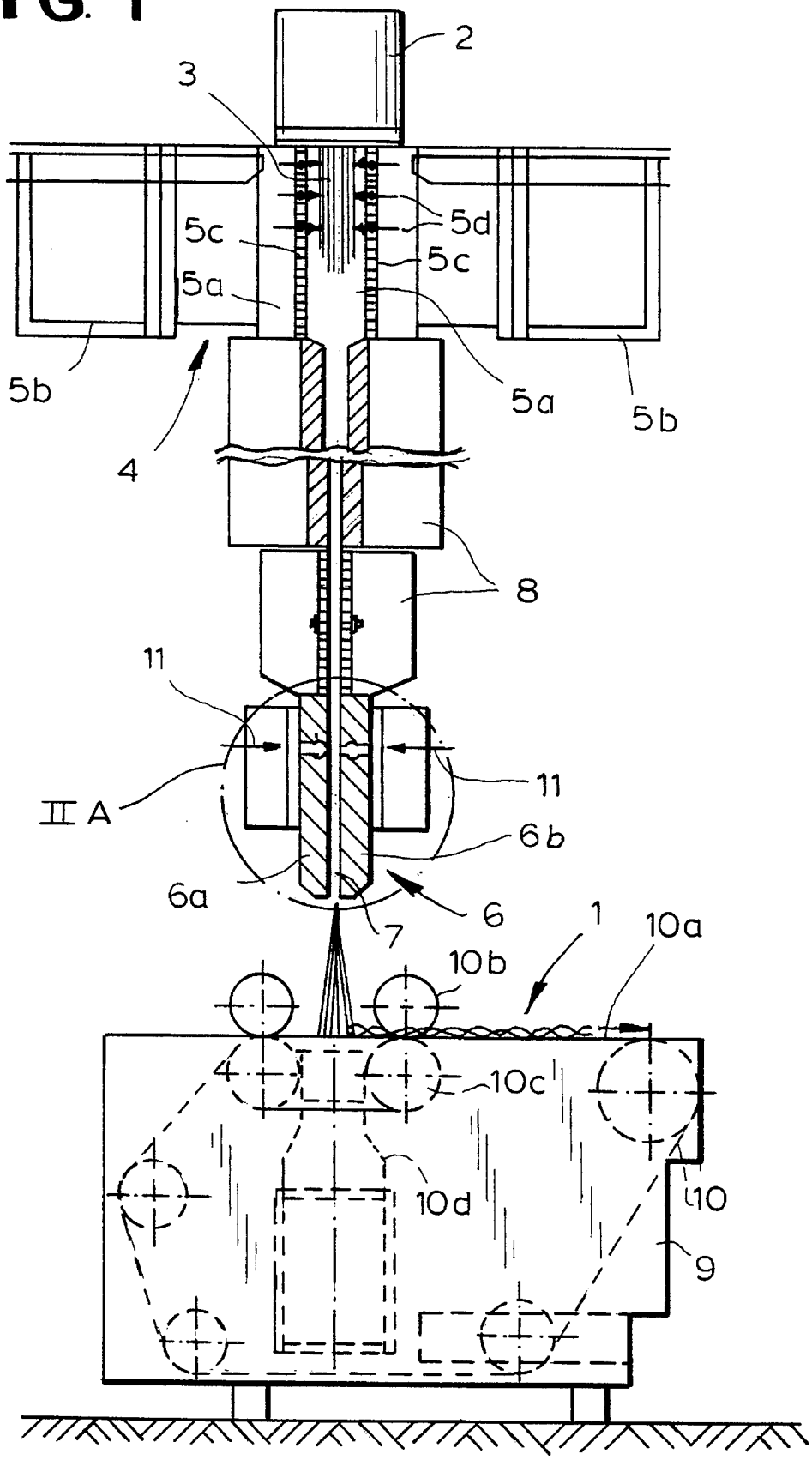
FIG. 1 is a vertical cross section through the spun-bond apparatus of the present invention.

The spun-bond apparatus shown in the drawing is designed for the continuous production of a nonwoven spun-bond web or fleece I of thermoplastic film. Basically this apparatus comprises a filament-spinning device or spinneret 2 from which a filament curtain 3 of the thermoplastified synthetic resin descends. Directly below the spinneret 2 is a cooling device 4 with a cooling air pressure chamber 5 designed to provide a cooling air pressure below 3 bar. Plenums 5*a* are supplied with the cooling air by ducts 5*b* from a blower system not shown and the cooling air enters the chamber 5 through perforated walls 5*c* as represented by the arrows 5*d*, the cooling air being directed generally transversely to the film curtain 3.

The filament curtain is discharged with the cooling air through an outlet gap arrangement 6 which forcibly directs the cooling air the filaments entrained thereby downwardly and, in this case, can be considered to be a downward blowing unit.

The outlet gap assembly 6 may comprise a pair of walls 6*a* and 6*b* defining a narrow clearance 7 between them and through which the air and filaments entrained thereby are accelerated.

Between the discharge gap assembly 6 and the cooling chamber 5, an intermediate duct or passage 8 is provided in which additional cooling can be carried out with the downwardly flowing cooling air and between the spinneret 2 and the outlet nozzle arrangement 6, the filament can be stretched by the aforementioned entrainment with the cooling air.

Below the outlet gap assembly 6, a perforated or air-permeable belt 10 is displaced with a horizontal stretch 10*a* receiving the jumbled filaments forming the nonwoven web. The filaments can be compressed between rollers 10*b* and 10*c* to compact the spun bond and the space below which the filaments collect can be evacuated by a suction unit 10*d*. The belt 10 and the other components last described may constitute a mat deposition unit 9.

Figure 2:
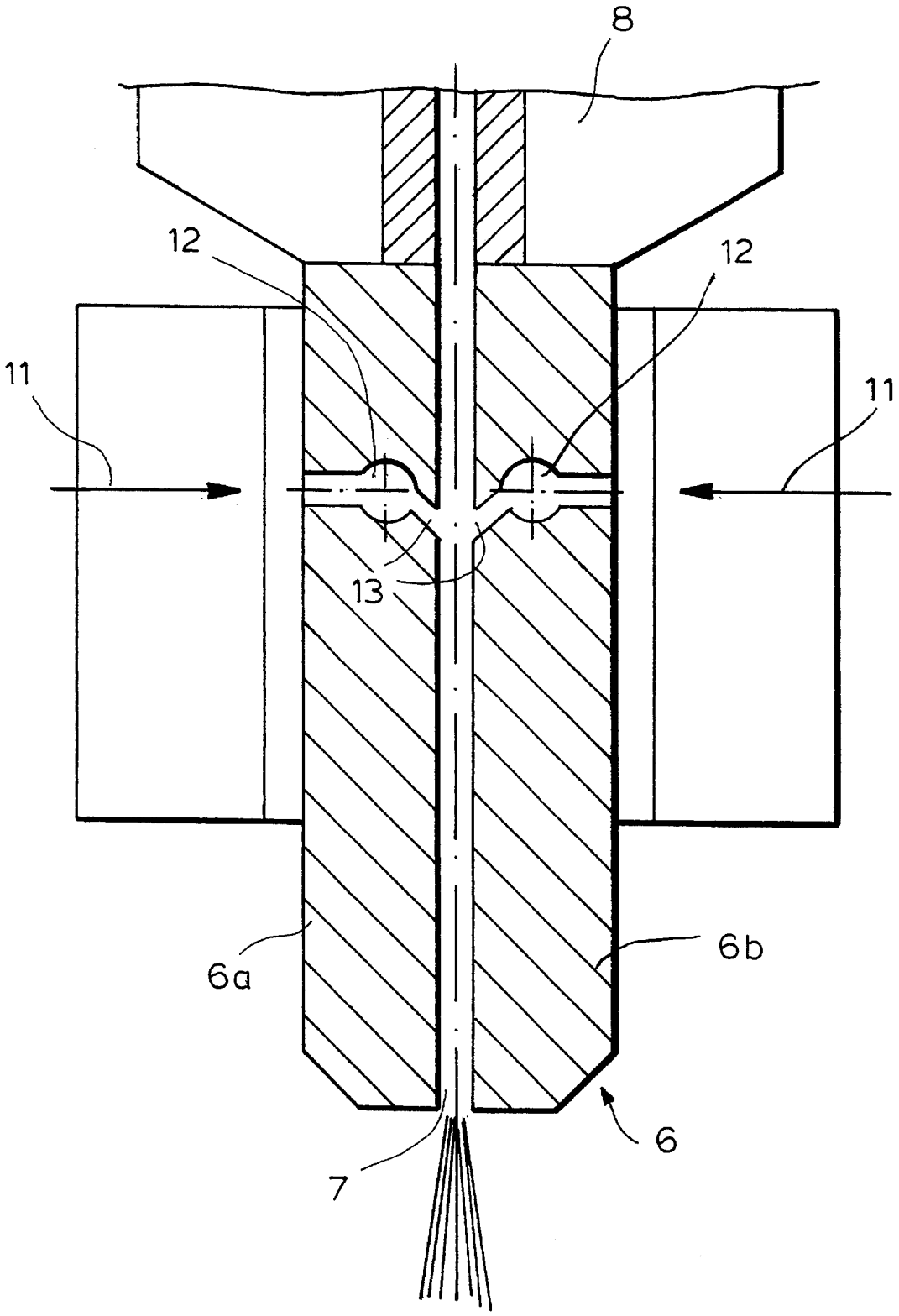
FIG. 2 is an enlarged detail view of the region II of FIG. 1.

As a comparison of FIGS. 1 and 2 will show, the discharge gap unit 6 can be provided additionally with duct work represented at 11, connected to a high-pressure source such as a compressor, for supplying jet nozzles 13 downstream of distributing channels 12 extending horizontally across the full width of the filament curtain. The nozzles 13 can be of circular cross section or slits extending the full width and are provided in the opposite walls 6*a* and 6*b* on opposite sides of the filament curtain and are trained downwardly toward the curtain.

In the embodiments illustrated the cooling unit 4 is designed to operate at a cooling air pressure of 0.05 to one bar while the jets 13 are supplied with air at high pressure, e.g. from less than 5 to 20 bar and preferably about 15 bar. The cross section reduction in the gap 7 can accelerate air which entrains filaments toward the nonwoven mat and can tear the filament at the region at which the jets are introduced.

Figure 3:
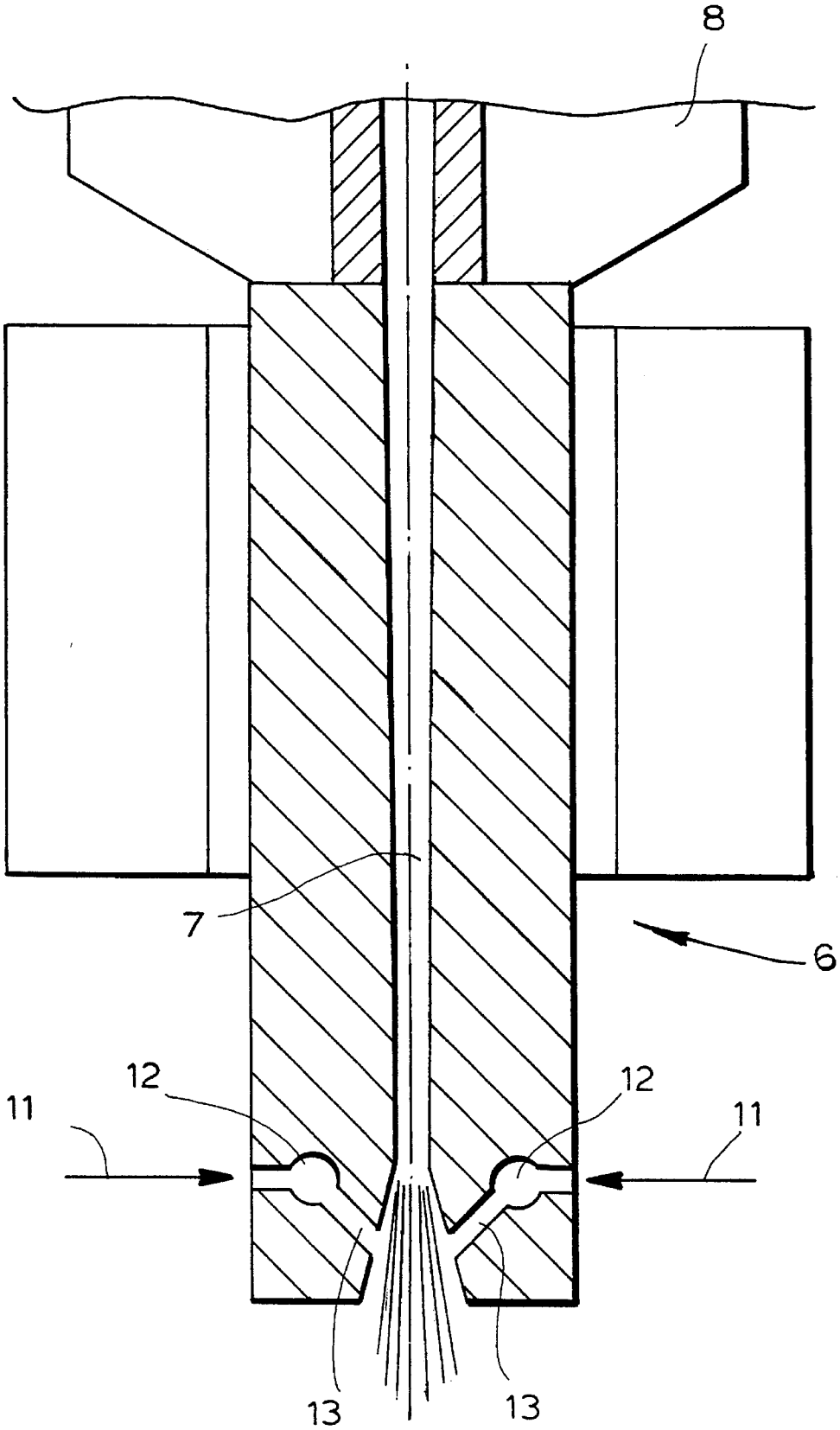
FIG. 3 is a view similar to FIG. 2 but of another embodiment.

As can be seen from FIG. 2, the jet nozzles 13 can be located closer toward the inlet or upper side of the gap 7 or, as seen in FIG. 3, closer toward the lower air outlet side of the gap 7.

As a result of the jets from the nozzles 13, drive air can entrain the filaments to establish the filament velocity at a predetermined value significantly higher than the values obtainable heretofore. Adjustment of the velocities by control of the pressure can regulate the speed or the speed can be set by the construction of the nozzle.

I claim:

1. In a method of operating a spun-bond apparatus for continuously producing a nonwoven web of thermoplastic synthetic resin filaments, wherein:

a downwardly moving curtain of said filaments formed by a spinneret passes in succession through a cooling chamber, an intermediate passage and a discharge gap to be collected in a nonwoven web upon a collecting conveyor belt below said discharge gap, the improvement which comprises the steps of:

directing jets of driving air against said curtain of filaments in said discharge gap and imparting to said filaments flow energy of said jets; and regulating a speed with which said filaments traverse said gap and collect upon said belt with said jets.

2. The improvement defined in claim 1 wherein said jets are directed against said curtain of filaments at a discharge end of said gap.

3. The improvement defined in claim 1 wherein said jets are directed against said curtain of filaments at an entry end of said gap.

4. The improvement defined in claim 1 wherein said jets are generated at a pressure of 5 to 20 bar.

5. The improvement defined in claim 4 wherein said jets are generated at a pressure of about 15 bar.

6. A method of continuously producing a spun-bond nonwoven web of thermoplastic synthetic resin filaments, said method comprising the steps of:

(a) generating a descending curtain of thermoplastified synthetic resin filaments in a spinneret;

(b) cooling said descending curtain of thermoplastified synthetic resin filaments in a cooling chamber below said spinneret and feeding a cooling air to said chamber at a pressure of less than 3 bar;

(c) passing said curtain of filaments through a discharge gap spaced below said cooling chamber for discharging filaments of said curtain downwardly;

(d) guiding said curtain of filaments along an intermediate passage between said cooling chamber and said discharge gap whereby cooling air from said cooling chamber and said curtain of filaments are guided into said discharge gap;

(e) collecting said curtain of filaments on a collecting conveyor belt below said discharge gap from said gap in a continuous nonwoven web;

(f) training jets of driving air against said curtain of filaments in said discharge gap and imparting to said filaments flow energy of said jets; and (g) supplying said driving air at a pressure of 5 to 20 bar to said jets.

* * * * *